US005267352A

United States Patent [19]

Rodarmel

[11] Patent Number: 5,267,352

[45] Date of Patent: Dec. 7, 1993

[54] UPPER TORSO RESTRAINING DEVICE

[76] Inventor: Pamlea A. Rodarmel, 3422 Old Bruceville Rd., Vincennes, Ind. 47591

[21] Appl. No.: 12,374

[22] Filed: Feb. 2, 1993

[51] Int. Cl.[5] ..... A41D 13/00

[52] U.S. Cl. ..... 2/2; 2/44; 2/95; 2/102; 2/114; 2/115; 2/103; 2/108; 2/243.1; 2/901; 297/464; 297/465; 128/846; 128/869; 128/870; 128/873; 128/874; 128/875

[58] Field of Search ..... 2/2, 44, 93, 95, 102, 2/103, 108, 114, 115, 243.1, DIG. 7; 128/846, 869, 870, 873, 874, 875; 297/464, 465

[56] References Cited

U.S. PATENT DOCUMENTS

| | | | |
|---|---|---|---|
| 866,342 | 9/1907 | Demacakos | 2/95 |
| 2,589,708 | 3/1952 | Koster | 128/873 |
| 2,908,324 | 10/1959 | Muller et al. | 2/102 |
| 3,407,807 | 10/1968 | Giberson | 2/114 |
| 3,641,997 | 2/1972 | Posey, Jr. . | |
| 4,026,282 | 5/1977 | Thomas | 128/873 |
| 4,170,991 | 10/1979 | Kella . | |
| 4,205,670 | 6/1980 | Owens | 128/875 |
| 4,382,335 | 5/1983 | Slocum . | |
| 4,488,544 | 12/1984 | Triunfol | 2/DIG. 7 |
| 4,676,554 | 6/1987 | Harlick et al. . | |
| 4,685,454 | 8/1987 | Posey | 128/873 |
| 4,744,354 | 5/1988 | Triunfol | 2/DIG. 7 |
| 4,795,176 | 1/1989 | Harrigan et al. . | |
| 4,832,053 | 5/1989 | McCarthy | 128/869 |
| 4,917,109 | 4/1990 | Ruge | 2/DIG. 7 |
| 5,084,914 | 2/1992 | Hesch . | |

FOREIGN PATENT DOCUMENTS

| | | | |
|---|---|---|---|
| 459200 | 4/1949 | Canada | 128/873 |
| 959721 | 3/1957 | Fed. Rep. of Germany | 128/874 |
| 272443 | 12/1978 | Fed. Rep. of Germany | 297/465 |

OTHER PUBLICATIONS

1990–1991 Posey Safety & Health Care Products catalog, pp. 5, 6, 7, 8, 12.

*Primary Examiner*—Clifford D. Crowder
*Assistant Examiner*—Gloria Hale
*Attorney, Agent, or Firm*—Plews & Shadley

[57] ABSTRACT

An upper torso restraining device is disclosed for maintaining an individual in a seated position in a chair or similar by providing attachment and support of the upper torso. An external upper body garment with appearance similar to ordinary clothing is provided with side slits. An interior vest having straps extending from front crossover and crossunder portions is attached to the upper body garment along the upper edges of the interior vest. Straps from the crossunder portion pass through one side of the interior vest through interior slits and straps from the crossover portion pass through external loops located on the opposing side of the interior vest. The straps then pass through the side slits, and may be secured together behind an individual wearing the interior vest and upper body garment.

18 Claims, 6 Drawing Sheets

UPPER TORSO RESTRAINING DEVICE

BACKGROUND OF THE INVENTION

1. Field of the Invention

As a result of illness or injury, many individuals lose the capability of maintaining themselves in a seated position. The present invention generally relates to devices for restraining the upper torso of such individuals so that the individual is maintained in a sitting position, and more specifically relates to devices for restraining individuals in a sitting position that have an external appearance similar to ordinary upper body clothing.

2. Description of the Prior Art

A frequent problem encountered in providing care to individuals who have difficulty remaining in a sitting position relates to the use of appropriate devices to it is common to maintain these individuals in a seated position by temporarily tying the individual to a chair, wheelchair or other support by various makeshift devices that may be uncomfortable for the individual, and, in addition, serve to stigmatize and embarrass the individual as requiring the help of a device to remain seated. Depending upon the needs of the individual, a restraining device that supports the upper torso, the pelvic region, or both the upper torso and the pelvic region may be required in particular instances.

Devices for maintaining an individual in a sitting position by providing support at the pelvic region are disclosed by U.S. Pat. Nos. 3,641,997, 4,026,282, and 4,676,554. A device for maintaining an individual in a sitting position by providing support of the upper torso is disclosed by U.S. Pat. No. 4,170,991. A device for maintaining an individual in a sitting position by providing support of both the upper torso and the pelvic region is disclosed by U.S. Pat. No. 4,795,176.

Despite the availability of such devices, there exists a need in the art for an upper torso restraining device that is capable of comfortably maintaining an individual in a sitting position, yet minimizes the external indications that a restraining device is in use by providing an appearance similar to ordinary upper body clothing.

SUMMARY OF THE INVENTION

In order to aid in the understanding of the present invention, it can be stated in essentially summary form that it is directed to an upper torso restraining device that has the external appearance similar to ordinary upper body clothing, yet is capable of securely and comfortably maintaining an individual in a seated position.

It is an object of the present invention to provide an upper torso restraining device that is capable of securely maintaining an individual in a seated position.

It is another object of the present invention to provide an upper torso restraining device that is capable of maintaining an individual in a seated position in a dignified manner.

It is another object of the present invention to provide an upper torso restraining device that is capable of use by either gender.

It is another object of the present invention to provide a restraining device that is capable of use by persons of all ages.

It is another object of the present invention to provide an upper torso restraining device that is unobtrusive and has the external appearance similar to ordinary clothing for the upper portion of the body.

It is another object of the present invention to provide an upper torso restraining device that is comfortable to use.

It is still another object of the present invention to provide an upper body restraining device that is capable of being easily and quickly removed from an individual, cleaned, and replaced.

It is yet another object of the present invention to provide an upper body restraining device relatively inexpensive to manufacture.

Further objects and advantages of the present invention will be apparent from a study of the following portion of the specification, the claims, and the attached drawings.

DESCRIPTION OF THE PREFERRED EMBODIMENT

The following portion of the specification, taken in conjunction with the drawings, sets forth the preferred embodiment of the present invention. The embodiment of the invention disclosed herein is the best mode contemplated by the inventor for carrying out her invention in a commercial environment, although it should be understood that various modifications can be accomplished within the parameters of the present invention.

Figure 1:
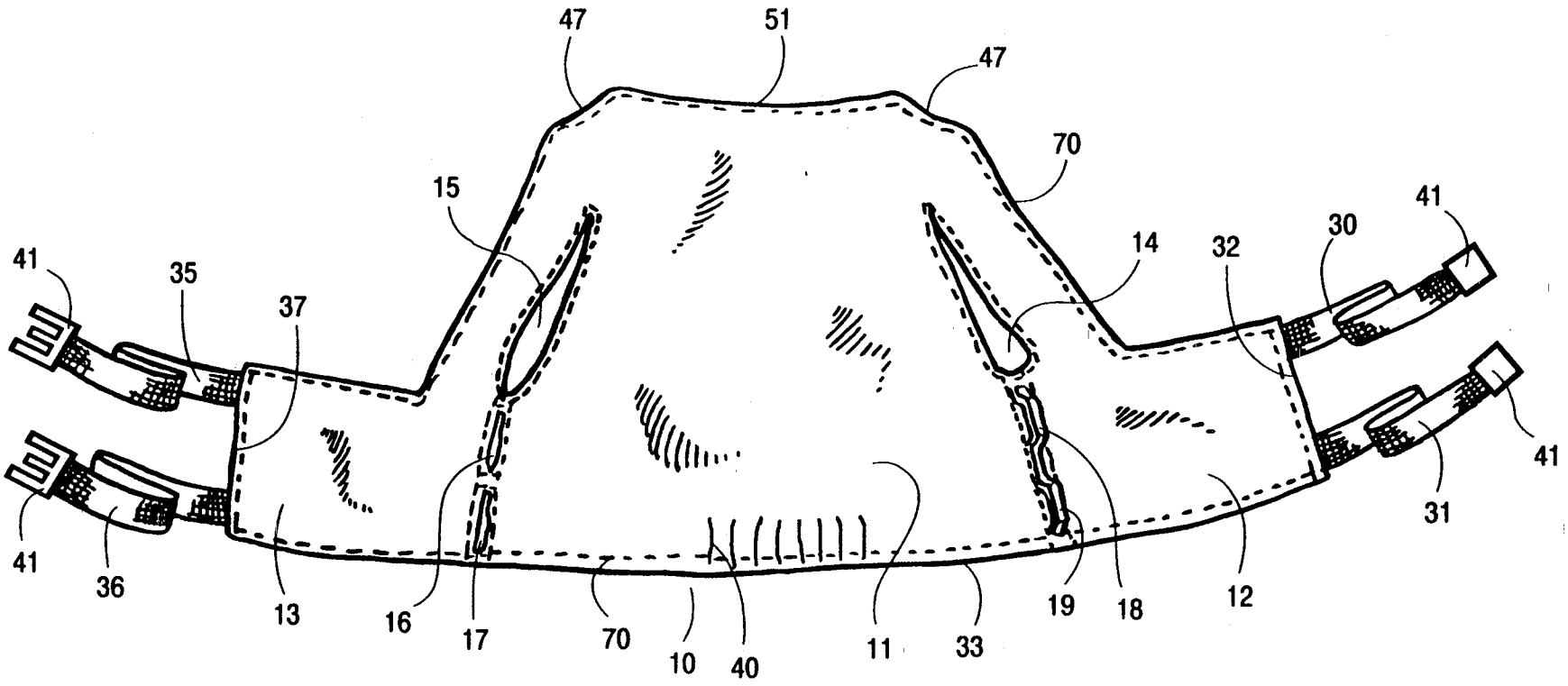
FIG. 1 is an elevational view of the exterior of the interior vest of an upper torso restraining device representing the present invention.

Referring now to the drawings for a detailed description of the present invention, reference is first made to FIG. 1 depicting the exterior of interior vest 10, having vest back 11, front crossunder portion 12, front crossover portion 13, first vest arm opening 14, second vest arm opening 15, upper interior slit 16, and lower interior slit 17. Upper interior slit 16 and lower interior slit 17 are disposed through interior vest 10, and upper loop 18 and lower loop 19 are attached to the outer surface of interior vest 10, for instance, by sewing. Resilient, flexible first upper strap 30 and first lower strap 31 are attached to front crossunder strap distal end 32 so that first upper strap 30 and first lower strap 31 are disposed generally parallel to bottom edge 33 of interior vest 10 and the distance between first upper strap 30 and first lower strap 31 is substantially the same as the distance between upper interior slit 16 and lower interior slit 17. As discussed below, in this way first upper strap 30 may be removably disposed through upper interior slit 16 and first lower strap 31 may be removably disposed through lower interior slit 17. Resilient, flexible second upper strap 35 and second lower strap 36 are attached to front crossover portion distal end 37 so that second upper strap 35 and second lower strap 36 are disposed generally parallel to bottom edge 33 and the distance between second upper strap 35 and second lower strap 36 is substantially the same as the distance between upper loop 18 and lower loop 19. Also as discussed below, in this way second upper strap 35 may be removably disposed through upper loop 18 and second lower strap 36 may be removably disposed through lower loop 19 after first upper strap 30 has been disposed through upper interior slit 16 and first lower strap 31 has been disposed through lower interior slit 17. Disposed linearly along generally bisecting bottom edge 33 are elastic segments 40, and clips 41 are attached to the distal ends of first upper strap 30, first lower strap 31, second upper strap 35 and second lower strap 36.

Interior vest 10 may be formed of two plies of flexible materials such as fabric, with the plies attached together, for instance by stitching 70. The exterior ply of interior vest 10 may be selected to be a sturdy, resilient fabric to provide the requisite structural strength, while the interior ply may be selected to be from soft, nonchafing materials that are comfortable to wearers of interior vest 10. In order to increase the structural integrity of the present invention, first lower strap 31 and second lower strap 36 may extend between the interior ply and the exterior ply of interior vest 10, attached to and disposed along the bottom edge of interior vest 10 for instance by sewing. Similarly, first upper strap 30 and second upper strap 35 may extend between the interior ply and the exterior ply of interior vest 10, attached to and disposed along the upper edges of crossunder portion 12 and crossover portion 13.

As depicted in FIGS. 2, 3, 4, and 5, flexible upper body garment 45 is formed to have the general appearance of a long sleeve, button front shirt having collar 46, first sleeve 52, second sleeve 53, open ended front slit 54, first upper side slit 55, first lower side slit 56, second upper side slit 57, and second lower side slit 58. Front slit 54 may be removably closed, for instance, by the use of buttons 59 and buttonholes 60. The distance between first upper side slit 55 and first lower side slit 56 may be selected to be substantially the same as the distance between upper interior slit 16 and lower interior slit 17. Similarly, the distance between second upper side slit 57 and second lower side slit 58 may be selected to be substantially the same as the distance between upper loop 18 and lower loop 19.

Figure 2:
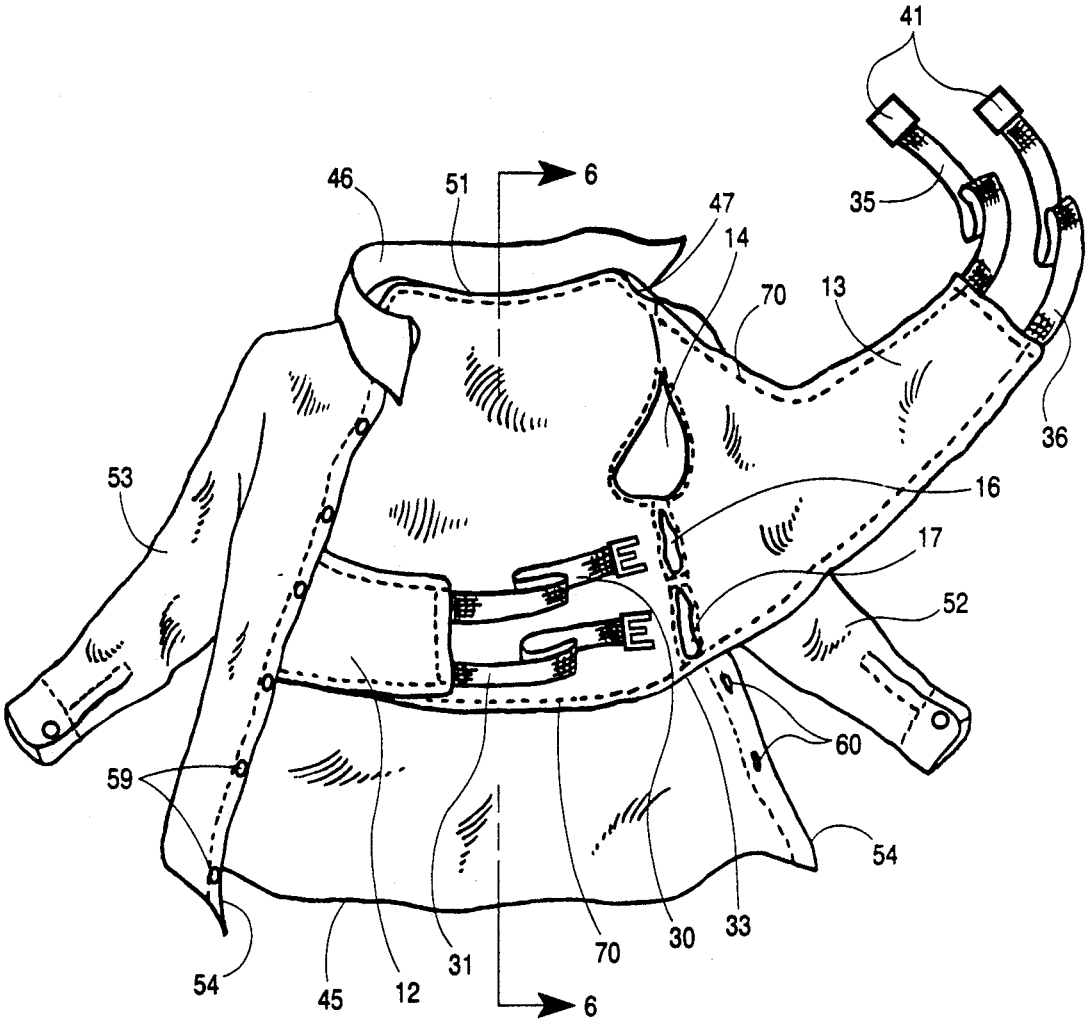
FIG. 2 is a front elevational view of an upper torso restraining device representing the present invention in an opened configuration.
Figure 6:
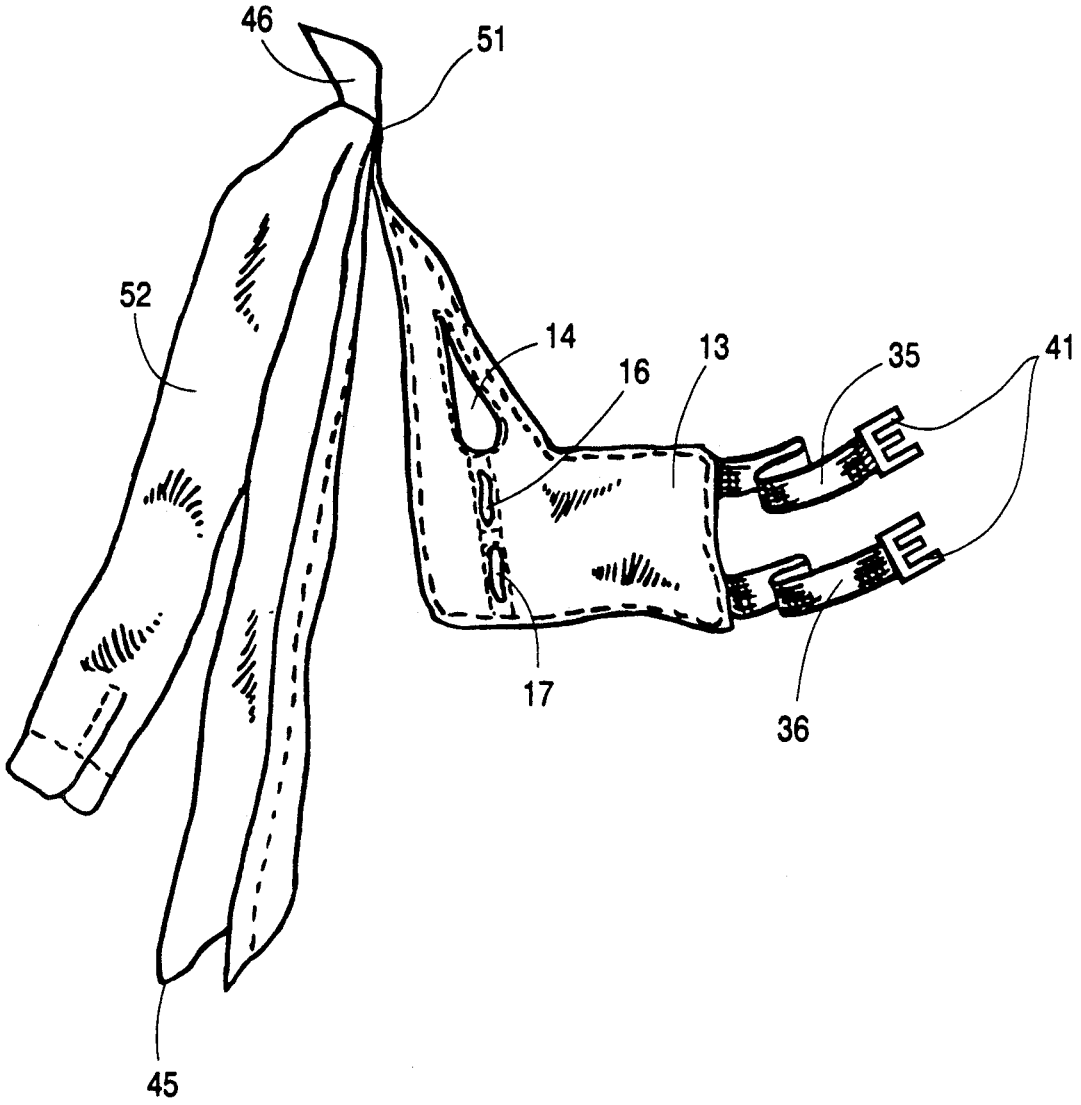
FIG. 6 is sectional view taken along line 6—6 of FIG. 2

Referring to FIGS. 1, 2, and 6, interior vest 10 is attached to upper body garment 45 along neck edge 51 and shoulder edges 47, for instance by sewing, effectively suspending interior vest 10 with respect to upper body garment 45. In this way, interior vest 10 and upper body garment 45, being formed of flexible materials, are capable of relative movement except along neck edge 51 and shoulder edges 47. As discussed below, although interior vest 10 will in general fit snugly to the upper torso of an individual, upper body garment 45 will in this way be capable of adjustment and movement with respect to the individual's upper torso in the manner of ordinary clothing, thereby increasing the comfort of the individual while closely approximating the external appearance of ordinary clothing.

Figure 3:
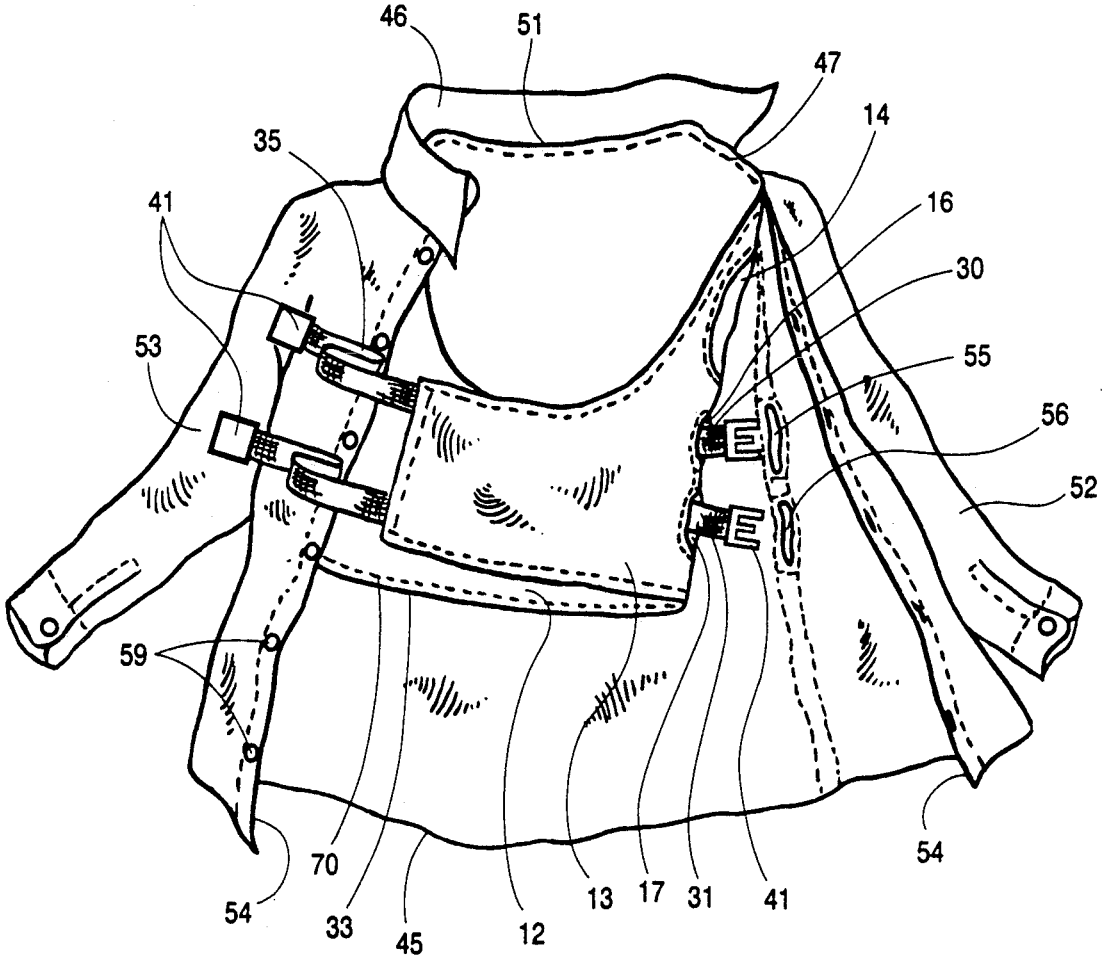
FIG. 3 is a front elevational view of an upper torso restraining device representing the present invention in a partially closed configuration.
Figure 4:
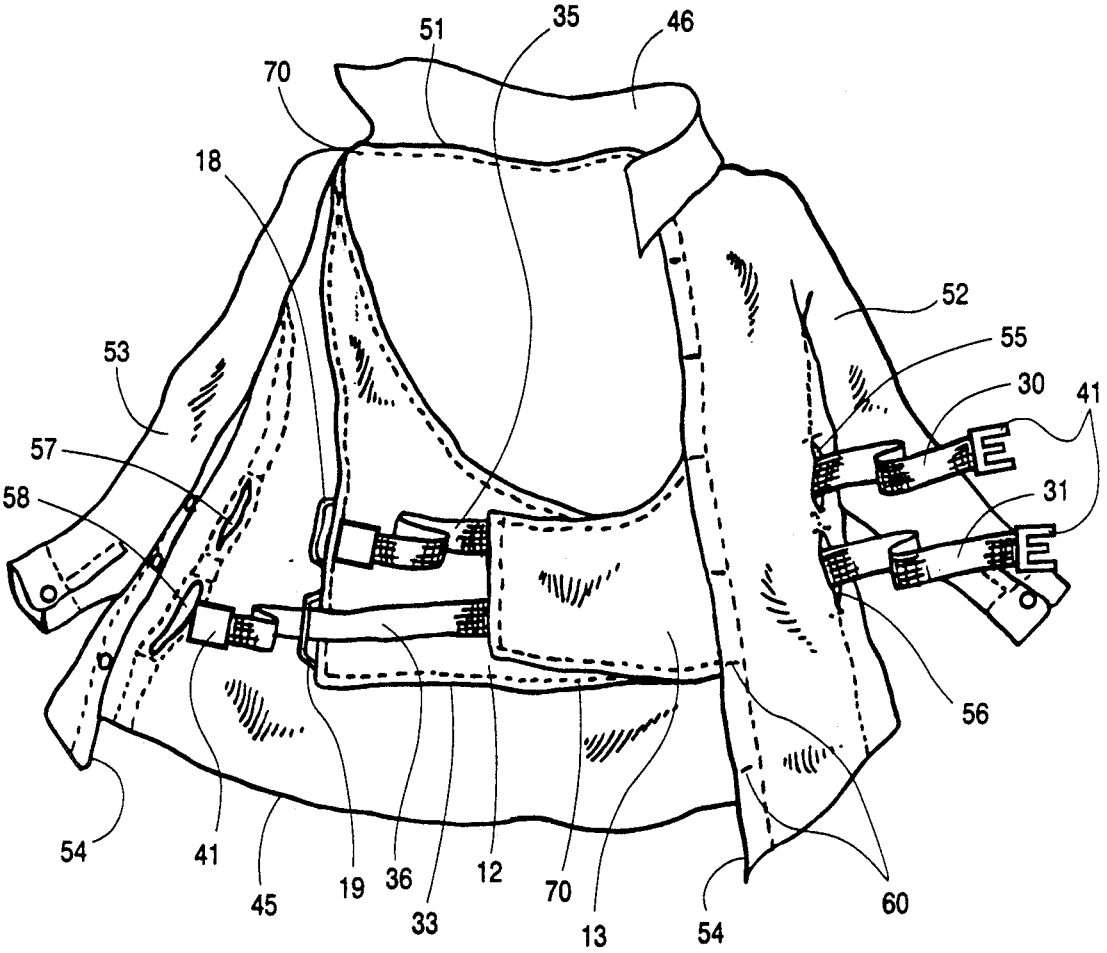
FIG. 4 is a front elevational view of an upper torso restraining device representing the present invention in a partially closed configuration.
Figure 5:
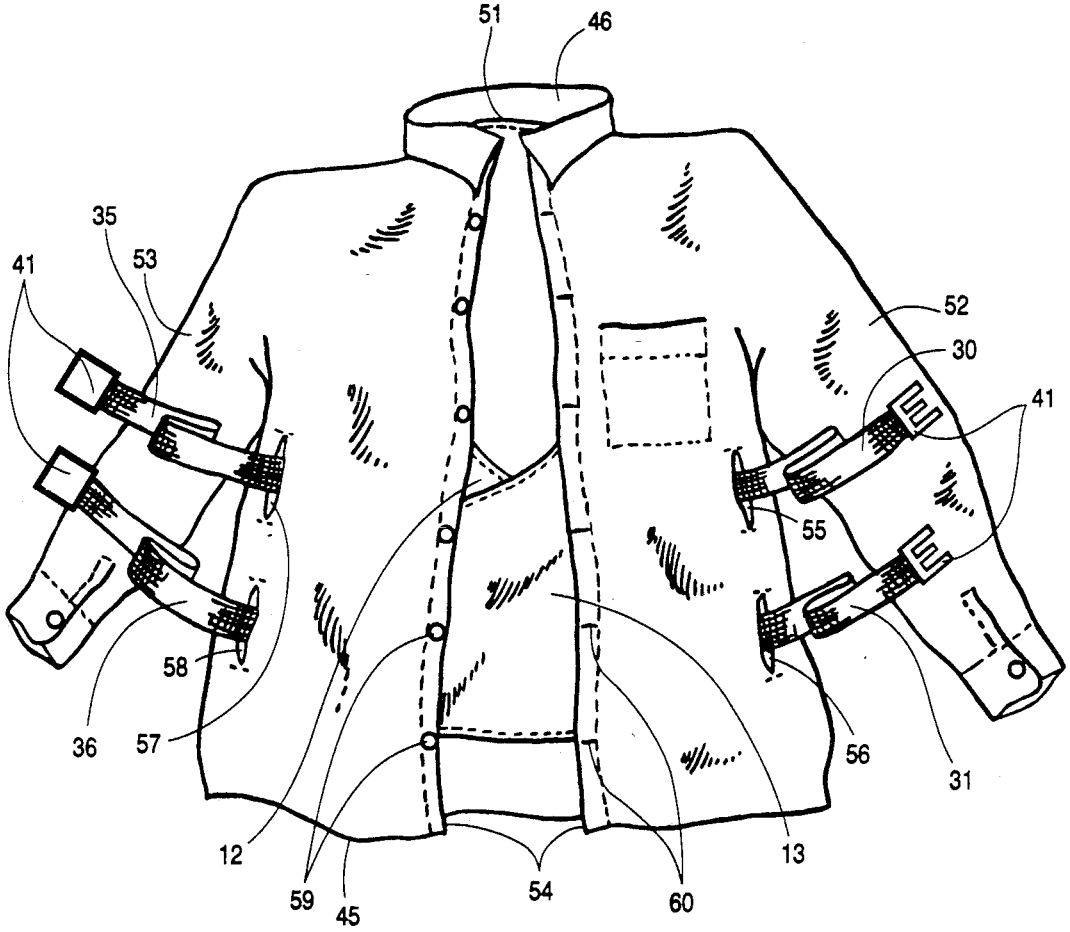
FIG. 5 is a front elevational view of an upper torso restraining device representing the present invention in a closed configuration.

As shown in FIG. 2, the present invention is readied for use by opening upper body garment 45 and interior vest 10 and inserting an individual's left arm through first vest arm opening 14 and first sleeve 52, and right arm through second vest arm opening 15 and second sleeve 53. Next, first upper strap 30 is inserted through upper interior slit 16 and first lower strap 31 is inserted through lower interior slit 17. FIG. 3 depicts first upper strap 30 after insertion through upper interior slit 16 and first lower strap 31 after insertion through lower interior slit 17, with front crossover portion 13 folded over front crossunder portion 12. The next step in the use of the present invention is the insertion of first upper strap 30 through first upper side slit 55, and first lower strap 31 through first lower side slit 56, as indicated in FIGS. 3 and 4. In FIG. 4, second upper strap 35 is depicted prior to insertion through upper loop 18, while second lower strap 36 is depicted after insertion through lower loop 19. As shown in FIGS. 4 and 5, after second upper strap 35 is inserted through upper loop 18 and second lower strap 36 is inserted through lower loop 19, second upper strap 35 is then inserted through second upper side slit 57 and second lower side strap 36 is then inserted through second lower side slit 58. Front slit 54 may be closed using buttons 59 and buttonholes 60, and after the individual is seated in a chair or similar, first upper strap 30 may be removably attached to second upper strap 35 and first lower strap 31 may removably attached to second lower strap 36 by connecting clips 41 behind the individual and the chair. In addition, connecting clips 41 may be omitted from the present invention, in which case first upper strap 30 may be removable attached to second upper strap 35 by tying together, and similarly by tying first lower strap 31 to second lower strap 36. In this way, the upper torso of an individual is supported and restrained within interior vest 10 with breathing and slight movements facilitated by elastic segments 40, maintaining the individual in a seated position while upper body garment 45 provides the external appearance similar to ordinary upper body clothing.

It will be understood that upper body garment 45 may be formed to have the general appearance of items of clothing other than a button front shirt with collar, and that such a change in general appearance may in some instances require modifications of the present invention as hereinabove described. For instance, upper body garment 50 20 may be formed to have the general appearance of a short sleeve shirt, a collarless shirt, or a shirt with a zippered or other means of removably closing front slit 54.

The present invention having been described in its preferred embodiment, it is clear that it is susceptible to numerous modifications and embodiments within the ability of those skilled in the art and without the exercise of the inventive faculty. Accordingly, the scope of the present invention is defined by the scope of the following claims.

What is claimed is:

1. Upper torso restraining device comprising:

a flexible upper body garment having a neck opening, a first arm opening, a second arm opening, an open ended front slit, a plurality of first side slits, a plurality of second side slits, said first and second arm openings disposed at opposite sides of said garment, said front slit extending between said neck opening and the bottom edge of said garment, said first side slits disposed linearly between said first arm opening and the bottom edge of said garment, and said second side slits disposed linearly between said second arm opening and the bottom edge of said garment;

means for removably closing said front slit;

a flexible interior vest having a vest back, a front crossunder portion, a front crossover portion, a first vest arm opening, a second vest arm opening, and a plurality of interior slits, said front crossunder portion and said front crossover portion generally disposed proximate to opposite sides of said interior vest, said first vest arm opening disposed between said vest back and said front crossunder portion, said second vest arm opening disposed between said vest back and said front crossover portion, said interior slits disposed linearly between said second vest arm opening and the bottom edge of said interior vest and through said interior vest so that the distances between said interior slits are substantially the same as the distances between said first side slits;

a plurality of loops;

means for attaching said loops to the outer surface of said interior vest so that said loops are disposed linearly between said first vest arm opening and the bottom edge of said interior vest, and the distances between said loops are substantially the same as the distances between said second side slits;

a plurality of resilient, flexible first straps, each having a first strap distal end and a first strap proximate end;

means for attaching said first strap proximate ends to said front crossunder portion so that said first straps are disposed generally parallel to the bottom edge of said interior vest and the distances between said first straps are substantially the same as the distances between said interior slits, and each of said first straps may be removably disposed through one of said interior slits;

a plurality of resilient, flexible second straps, each having a second strap distal end and a second strap proximate end;

means for attaching said second strap proximate ends to said front crossover portion so that said second straps are disposed generally parallel to the bottom edge of said interior vest and the distances between said second straps are substantially the same as the distances between said loops, and each of said second straps may be removably disposed through one of said loops after said first straps have been disposed through said interior slits; and means for attaching the upper portion of said interior vest to the interior of the upper portion of said garment so that said first arm opening and said first vest arm opening are aligned, said second arm opening and said second vest arm opening are aligned, each of said first straps may be removably disposed through one of said first side slits after being disposed through one of said interior slits, and each of said second straps may be removably disposed through one of said second side slits after being disposed through one of said upper loops.

2. Upper torso restraining device as defined in claim 1 wherein said vest back further comprises a plurality of elastic segments linearly disposed along the bottom edge of said vest back.

3. Upper torso restraining device as defined in claim 1 further comprising means for removable attaching each of said first strap distal ends to one of said second strap distal ends.

4. Upper torso restraining device as defined in claim 3, wherein said upper body garment further comprises flexible first sleeve attached to the exterior of said upper body garment at said first arm opening and a flexible second sleeve attached to the exterior of said upper body garment at said second arm opening.

5. Upper torso restraining device as defined in claim 4, wherein said means for attaching the upper portion of said interior vest to the interior of the upper portion of said garment comprises sewing to said garment proximate to said neck opening, between said neck opening and said first arm opening, and between said neck opening and said second arm opening.

6. Upper torso restraining device as defined in claim 5, wherein said means for removably closing said front slit comprises a hook and loop fastener attached along the sides of said front slit.

7. Upper torso restraining device as defined in claim 5, wherein said means for removably closing said front slit comprises a plurality of snaps attached along the sides of said front slit.

8. Upper torso restraining device as defined in claim 5, wherein said means for removably closing said front slit comprises a plurality of buttons and buttonholes attached along the sides of said front slit.

9. Upper torso restraining device as defined in claim 5, wherein said means for removably closing said front slit comprises a zipper attached along the sides of said front slit.

10. Upper torso restraining device comprising:

a flexible upper body garment having a neck opening, a first arm opening, a second arm opening, an open ended front slit, a first upper side slit, a first lower side slit, a second upper side slit, and a second lower side slit, said first and second arm openings disposed at opposite sides of said garment, said front slit extending between said neck opening and the bottom edge of said garment and disposed generally normal to the bottom edge of said garment and between said first and second arm openings, said first upper side slit disposed between said first arm opening and the bottom edge of said garment, said first lower side slit disposed between said first upper side slit and the bottom edge of said garment, said second upper side slit disposed between said second arm opening and the bottom edge of said garment, and said second lower side slit disposed between said second upper side slit and the bottom edge of said garment;

means for removably closing said front slit;

a flexible interior vest having a vest back, a front crossunder portion, a front crossover portion, a first vest arm opening, a second vest arm opening, an upper interior slit, and a lower interior slit, said front crossunder portion and said front crossover portion generally disposed proximate to opposite sides of said interior vest, said first vest arm opening disposed between said vest back and said front crossunder portion, said second vest arm opening disposed between said vest back and said front crossover portion, said upper interior slit and said lower interior slit disposed through said interior vest and between said second vest arm opening and the bottom edge of said interior vest so that the distance between said upper interior slit and said lower interior slit is substantially the same as the distance between said first upper side slit and said first lower side slit;

an upper loop;

a lower loop;

means for attaching said upper loop and said lower loop to the outer surface of said interior vest so that said upper loop is disposed between said first vest arm opening and the bottom edge of said interior vest, said lower loop is disposed between said upper loop and the bottom edge of said interior vest, and the distance between said upper loop and said lower loop is substantially the same as the distance between said second upper side slit and said second lower side slit;

a resilient, flexible first upper strap having a first upper strap distal end and a first upper strap proximate end;

a resilient, flexible first lower strap having a first lower strap distal end and a first lower strap proximate end;

means for attaching said first upper strap proximate end and said first lower strap proximate end to said front crossunder portion so that said first upper strap and said first lower strap are disposed generally parallel to the said bottom edge of said interior vest and the distance between said first upper strap and said first lower strap is substantially the same as the distance between said upper interior slip and said lower interior slit, and said first upper strap may be removably disposed through said upper interior slit and said first lower strap may be removably disposed through said lower interior slit;

a resilient, flexible second upper strap having a second upper strap distal end and a second upper strap proximate end;

a resilient, flexible second lower strap having a second lower strap distal end and a second lower strap proximate end;

means for attaching said second upper strap proximate end and said second lower strap proximate end to said front crossover portion so that said second upper strap and said second lower strap are disposed generally parallel to the bottom edge of said interior vest and the distance between said second upper strap and said second lower strap is substantially the same as the distance between said upper loop and said lower loop, and said second upper strap may be removably disposed through said upper loop and said second lower strap may be removably disposed through said lower loop after said first upper strap has been disposed through said upper interior slit and said first lower strap has been disposed through said lower interior slit; and means for attaching said interior vest to the interior of said garment proximate to said neck opening, between said neck opening and said first arm opening, and between said neck opening and said second arm opening so that said first arm opening and said first vest arm opening are aligned, said second arm opening and said second vest arm opening are aligned, said first upper strap may be removably disposed through said first upper side slit after being disposed through said upper interior slit, said first lower strap may be removably disposed through said first lower side slit after being disposed through said lower interior slit, said second upper strap may be removably disposed through said second upper side slit after being disposed through said upper loop, and said second lower strap may be removably disposed through said second lower side slit after being disposed through said lower loop.

11. Upper torso restraining device as defined in claim 10 wherein said vest back further comprises a plurality of elastic segments linearly disposed along the bottom edge of said vest back.

12. Upper torso restraining device as defined in claim 11 further comprising means for removably attaching said first upper strap distal end to said second upper strap distal end and removably attaching said first lower strap distal end to said second lower strap distal end.

13. Upper torso restraining device as defined in claim 12 wherein said upper body garment further comprises a flexible first sleeve attached to the exterior of said upper body garment at said first arm opening and a flexible second sleeve attached to the exterior of said upper body garment at said second arm opening.

14. Upper torso restraining device as defined in claim 13, wherein said means for attaching said interior vest to the interior of said garment comprises sewing to the interior of said garment proximate to said neck opening, between said neck opening and said first arm opening, and between said neck opening and said second arm opening.

15. Upper torso restraining device as defined in claim 14, wherein said means for removably closing said front slit comprises a hook and loop fastener attached along the sides of said front slit.

16. Upper torso restraining device as defined in claim 14, wherein said means for removably closing said front slit comprises a plurality of snaps attached along the sides of said front slit.

17. Upper torso restraining device as defined in claim 14, wherein said means for removably closing said front slit comprises a plurality of buttons and buttonholes attached along the sides of said front slit.

18. Upper torso restraining device as defined in claim 14, wherein said means for removably closing said front slit comprises a zipper attached along the sides of said front slit.

* * * * *